United States Patent [19]

Gustafsson

[11] 4,007,603

[45] Feb. 15, 1977

[54] APPARATUS FOR DEFROSTING OF AN EVAPORATOR IN A HEAT PUMP

[75] Inventor: Berth Ulrik Gustafsson, Osterskar, Sweden

[73] Assignee: Projectus Industriprodukter AB, Stockholm, Sweden

[22] Filed: May 6, 1975

[21] Appl. No.: 575,037

[30] Foreign Application Priority Data

May 10, 1974 Sweden ..... 74063165

[52] U.S. Cl. ..... 62/151; 62/324

[51] Int. Cl.[2] ..... F25D 21/06; F25B 13/00

[58] Field of Search ..... 62/80, 151, 152, 154, 62/160, 324

[56] References Cited

UNITED STATES PATENTS

| | | | |
|---|---|---|---|
| 2,939,295 | 6/1960 | Robson | 62/151 |
| 3,076,316 | 2/1963 | Schlichtig | 62/324 |
| 3,107,499 | 11/1963 | Jokela | 62/151 |
| 3,371,502 | 3/1968 | Heidorn | 62/324 |
| 3,465,534 | 9/1969 | Sutton, Jr. et al. | 62/151 |
| 3,643,457 | 2/1972 | Winkler | 62/151 |

*Primary Examiner*—Lloyd L. King
*Attorney, Agent, or Firm*—Toren, McGeady and Stanger

[57] ABSTRACT

In an apparatus for defrosting an evaporator in a heat pump which is driven by a compressor, the evaporator consists of a fan and a heat exchanger through which the fan drives air for heat exchange with the heat transport medium flowing through the heat exchanger. A pressure sensitive switch is arranged to actuate a member for reversal of the pumping direction of the compressor when the pressure differential $\sigma p$ of the air over the heat exchanger has reached a predetermined value, and a temperature sensitive switch which senses the temperature at the heat exchanger, is arranged to actuate the reversal member to maintain the reversed pumping direction of the compressor as long as the temperature at the heat exchanger is less than or equal to 0° C.

3 Claims, 2 Drawing Figures

APPARATUS FOR DEFROSTING OF AN EVAPORATOR IN A HEAT PUMP

Figure 1:
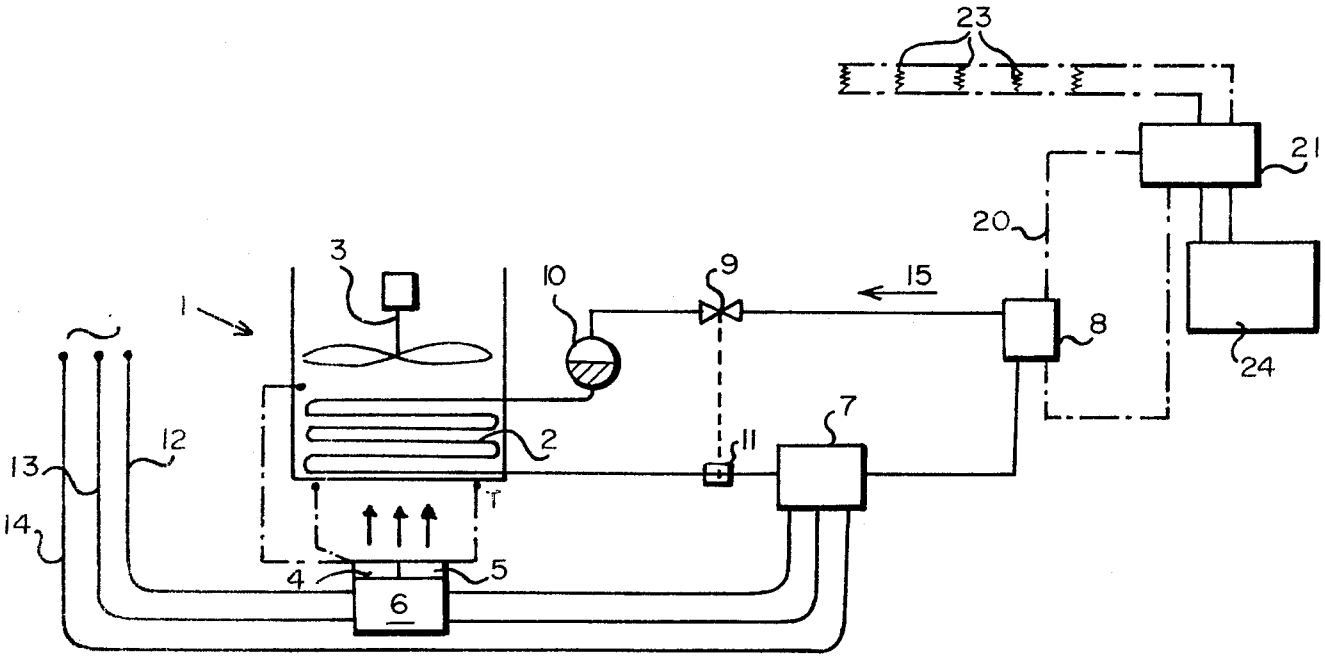

The present invention refers to an apparatus for defrosting of an evaporator in a compressor driven heat pump, the evaporator comprising a fan means and a heat exchanger over which the fan flows air for heat exchange with the heat transport medium of the heat pump flowing through the heat exchanger.

In heat pump evaporators positioned outdoors a frost- or ice formation occurs fairly often which tends to deteriorate or render the heat exchange between ambient air and the refrigerant medium of the heat pump impossible. The formation of such ice is dependant on the temperature and the moistness of the ambient air and the temperature of the refrigerant medium in the evaporator. The ice formation has been observed to be especially rich in early spring and late autumn when the air moistness is high and the air temperature is around 0° C.

In order to remove the formed ice from the evaporator it is close at hand to reverse the heat pump so as to use the heat contained in the plant to defrost the evaporator. However, the difficulty has been to initiate such a reversal exactly when the demand for defrosting has occurred. Previously, timers have been used in order to reverse the heat pump at predetermined time intervals, and these time intervals have possibly been adjustable to a presumed necessary defrosting for the season in question. This known way of defrosting a heat exchanger is, however, for obvious reasons very uneconomical and unreliable. Another suggested method of solving the defrosting problem is to arrange an electrical heating coil at the heat exchanger. However, a power of around 50 kW is required in order to keep the defrosting time reasonably low and therefore also the electrical defrosting has been shown to be unfavourable. The method presently used for defrosting has been shown to be unfavourable. The method presently used for determining the suitable moment and time period for defrosting an evaporator, involves manual supervision and reversal.

The object of the present invention is to provide an apparatus for automatic determination of the degree of the ice formation in the evaporator and for automatic reversal of the heat pump during exactly such time period that is necessary in order to obtain a complete defrosting.

The procedure mentioned in the introduction is, according to the invention, characterized by detecting the pressure reduction of the air over the heat exchanger, reversing the flow direction of the heat pump when said pressure reduction has reached a predetermined rate, detecting the temperature at the last defrostable parts of the heat exchanger, and reversing the flow of the heat pump to normal operation when the detected temperature exceeds 0° C.

A device for carrying this procedure into effect is characterized in that a pressure sensitive means is arranged to actuate a means for reversal of the pumping direction of the compressor when the pressure reduction of the air over the heat exchanger has reached a predetermined value, and in that a temperature sensitive means which detects the temperature at the heat exchanger is arranged to actuate the reversal means to maintain the reversed pumping direction of the compressor as long as the temperature at the heat exchanger is less than or equals 0° C. The reversal means may then be arranged also to turn of the fan during the reversed compressor operation.

By means of a pressure sensitive switch it is possible to detect the difference between the pressure of the ambient air and the air pressure at the input or output side of the fan. This pressure sensitive switch can then via some relay or the like accomplish a phase shift and thereby a reversal of the compressor motor if the motor is a three-phase-motor. Preferably the current feed to the fan motor is interrupted during the reversal of the compressor motor. The temperature detection means may be arranged to be activated after the moment when the pressure switch has reversed the compressor motor, and the temperature detector is preferably arranged to maintain the phase shift as long as it senses a temperature which is less than or equal to 0° C. When the temperature exceeds 0° C the ice has with high probability melted away from the heat exchanger so that the heat pump can begin to work normally again with a high efficiency. Therefore the temperature detector is utilized to control a recoupling of the phases to normal position so that the compressor can operate in normal manner. Of course the pressure detecting means and the temperature detecting means may be permitted to control other means for reversal of the normal feed direction for the heat pump. Thus it is quite possible to let said two means control, for example, valve arrangements at the compressor or to control a shunt pipe system in the heat pump for reversing the flow direction of the heat pump.

Figure 2:
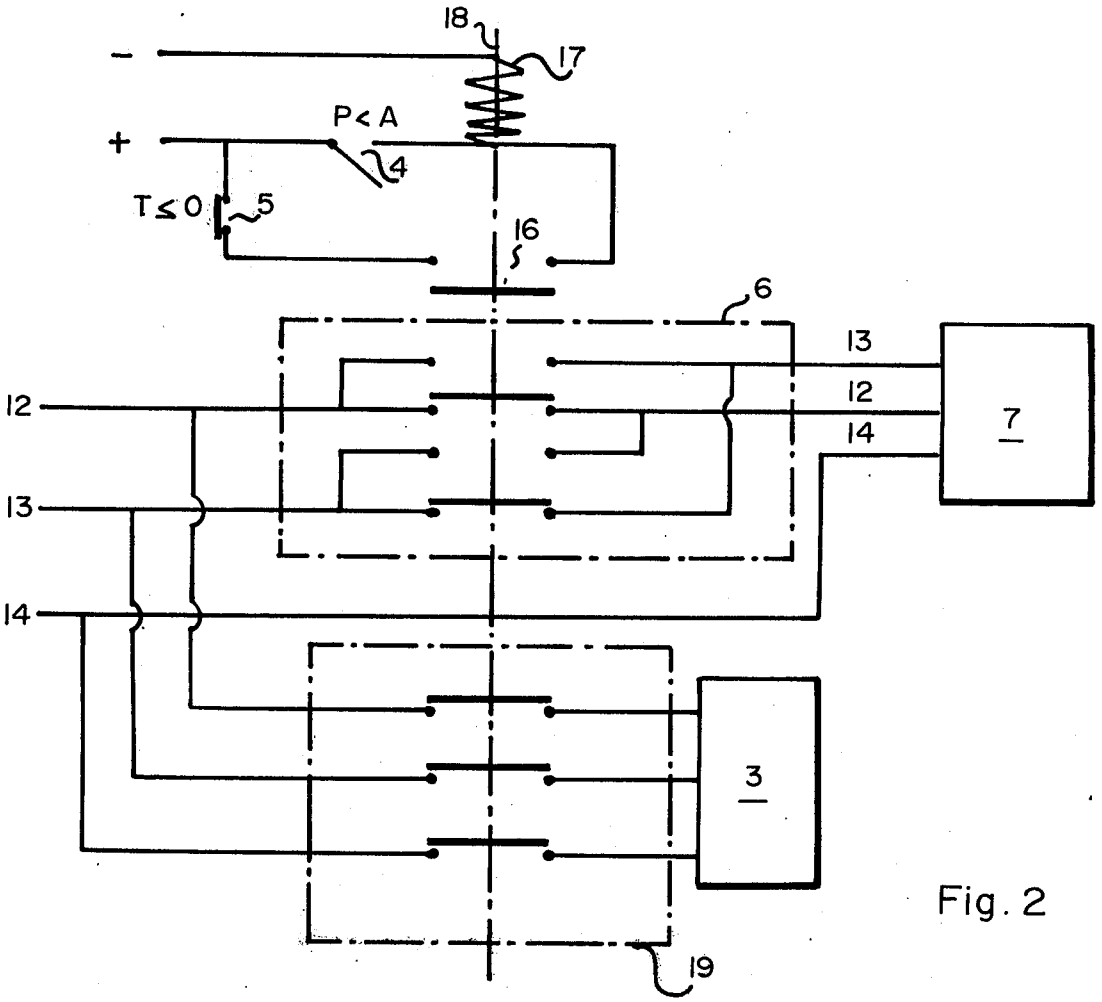

In the following the invention will be described in the form of a schematic example of an embodiment with reference to the attached drawings in which FIG. 1 schematically shows a heat pump at which the apparatus according to the invention is utilized. FIG. 2 shows a possible design of the control means for reversing the flow direction of the heat pump in response to the pressure and temperature conditions at the evaporator of the heat pump.

FIG. 1 shows a heat pump comprising an evaporator which is generally designated 1. The evaporator comprises a heat exchanger 2 and a fan 3 and these members are conventionally built into a cylindrical housing. The heat pump comprises in series a compressor 7, a condensor 8, an expansion valve 9 and a drop trap 10. The valve 9 may be arranged to be controlled by the pressure prevailing in the heat pump at 11. The normal flow direction of the heat pump is indicated by the arrow 15.

One can assume that the compressor motor is driven with a three-phase 12, 13, 14 alternating current. In order to reverse the rotational direction of the compressor motor the phases 12 and 13, for example, can be shifted. A means 6 is connected to the phases 12, 13 in order to shift them at an actuation. The phase shifting means 6 is controlled partly by a pressure sensitive switch 4 and partly a temperature sensitive switch 5. The pressure switch detects the pressure difference between the prevailing air pressure and the pressure at the inlet side of the fan 3. When this pressure difference reaches a value A the means 6 is controlled to shift the phases 12 and 13 in order to thereby reverse the compressor motor and thereby the flow direction of the heat pump. The pressure switch 4 activates the temperature switch 5 at the same time as it brings the means 6 to shift phases. The temperature means 5 maintains the phases 12 and 13 shifted as long as the detected temperature is less than or equals 0° C, i.e., as long as ice exists at the heat exchanger 2. When the temperature exceeds 0° C, the temperature switch 5 controls the means 6 to bring the phase order back to normal, i.e., such that the compressor 7 pumps the refrigerant medium in the direction of arrow 15.

In FIG. 2 there is shown an example of the schematically outlined control functions 4, 5 and 6 of FIG. 1, and how the fan motor may be coupled in the electrical system. The control means are arranged for the case when the compressor 7 and the fan 3 is three-phase-fed.

In the upper part of FIG. 2 there is shown a control current circuit comprising the switches 4 and 5. The circuit comprises a relay coil 17 and a shaft 18 displaceable by the coil. Further a contact bridge 16 is coupled to the shaft 18 in order to activate the temperature switch 5 when the phases have been shifted. The phase shifting means 6 is of conventional type and comprises contact bridges which are coupled to the shaft 18, said contact bridges shifting the phases 12, 13 when the shaft 18 is axially displaced. A current switch 19 of ordinary type is coupled to the shaft 18 in order to break the current feed of thhe fan when the compressor is reversed.

FIG. 2 shows the position of the contact bridges during normal operation of the heat pump. The temperature of the evaporator is normally substantially lower than 0° C due to a low vaporization temperature of the refrigerant medium, while the air pressure reduction over the heat exchanger is lower than the value A that determines the start of the defrosting. The temperature switch 5 is kept inactive as the control current circuit is broken at 16. If the pressure differential over the heat exchanger 2 raises to the value A the switch 4 will close the control current circuit so that the coil 17 is energized and lifts the shaft 18. Hereby the contact 16 will close and break the contact means 19 whereby the pressure differential $\delta p$ will decrease. The temperature is however lower than or equals 0° C due to the evaporation temperature of the refrigerant medium and the temperature of ice coating and therefore the switch 5 is kept closed, and thanks to the fact that contact 16 is closed this means that the coil 17 is kept energized and also keeps the shaft 18 in the upper position. Hereby the phase shifter 6 shifts the illustrated phases 12, 13 as soon as the pressure is equal to or higher than the value A whereafter this phase position is maintained as long as the sensed temperature is less than or equals to 0° C. As soon as the temperature exceeds 0° C the switch 5 will open, and as the fan 3 is deenergized the pressure $\delta p$ is less than A, i.e. the switch 4 is open also, and this results in that the shaft 18 falls down and shifts back the phases to normal position so that the heat pump can be utilized in the intended manner.

The position of the sensing body of the temperature switch 5 may of course have to be varied at different plants, but for each type of evaporator characteristic ice formation positions can be observed after a short operation time and the temperature sensing body should be placed at the most significant ice formation position. Further the most suitable distance between the sensing body and the surface of the evaporator can be chosen empirically.

In FIG. 1 a water circuit 20 is schematically shown in connection with the condensor 8 of the heat pump. The water of circuit 20 is heated by the condensor 8 and is when necessary further heated by a conventional boiler 21 preferably an oil fired boiler from which the water is directed, possibly via not shown shunts and dilution valves, to a heat exchanger for the heating of tap water, and radiators 23 respectively.

During the reversing of the heat pump for defrosting of the evaporator 1 the necessary heat energy can be drawn from the heat transport medium of the heat pump and also from the hot water of the system 20, 21, 23, 24 via the condensor 8.

What is claimed is:

1. In a heat pump including a compressor for directing the flow of a heat transfer medium through said heat pump, said compressor being capable of reversing the direction of flow of the heat transfer medium through said heat pump, an evaporator, said evaporator including a fan and a heat exchanger to which the heat transfer medium flows from said compressor, said fan arranged to drive air over said heat exchanger for indirect heat exchange with the heat transfer medium flowing through said heat exchanger, the exterior surface of said heat exchanger being subject to the accumulation of a frost or ice formation during operation of said heat pump, wherein the improvement comprises means associated with said compressor for reversing the direction of flow of the heat transfer medium through said heat pump, pressure sensitive means operatively connected to said reversing means for said compressor and said pressure sensitive means arranged to sense the pressure differential of the air flowing over said heat exchanger and to compare it with a predetermined value so that the direction of flow of the heat transfer medium provided by said compressor can be reversed when the pressure differential reaches the predetermined value, and a temperature sensitive means located for sensing the temperature at the exterior surface of said heat exchanger, said temperature sensitive means operatively connected to said reversing means for said compressor for maintaining the reversed pumping direction of said compressor as long as the temperature at said heat exchanger is less than or equal to 0° C.

2. In a heat pump, as set forth in claim 1, wherein said reversing means is arranged to disconnect said fan when the pumping direction of said compressor is reversed for removing ice formation from said heat exchanger.

3. In a heat pump, as set forth in claim 2, wherein said compressor includes a three-phase motor, a control current circuit including said pressure sensitive means and said temperature sensitive means, said control current circuit also including a relay coil, and a shaft displaceable by said coil, contact bridges mounted on said shaft and including a first said contact bridge for activating said temperature sensitive means and second said contact bridges for shifting phases of said three-phase motor for reversing the pumping direction of said compressor, said fan including an electric motor, and a current switch coupled to said shaft for breaking the current supply to said fan motor when the pumping direction of said compressor is reversed.

* * * * *